US010377568B2

(12) United States Patent
Rimsa

(10) Patent No.: US 10,377,568 B2
(45) Date of Patent: Aug. 13, 2019

(54) REFUSE COLLECTION SYSTEM

(71) Applicant: Perkins Manufacturing Co., Romeoville, IL (US)

(72) Inventor: James Rimsa, Maywood, IL (US)

( * ) Notice: Subject to any disclaimer, the term of this patent is extended or adjusted under 35 U.S.C. 154(b) by 299 days.

(21) Appl. No.: 15/379,716

(22) Filed: Dec. 15, 2016

(65) Prior Publication Data

US 2017/0174429 A1 Jun. 22, 2017

Related U.S. Application Data

(60) Provisional application No. 62/271,089, filed on Dec. 22, 2015.

(51) Int. Cl.
*B65F 3/04* (2006.01)
*B65F 3/02* (2006.01)

(52) U.S. Cl.
CPC ..... *B65F 3/041* (2013.01); *B65F 2003/023* (2013.01); *B65F 2003/0276* (2013.01); *B65F 2003/0279* (2013.01)

(58) Field of Classification Search
CPC ..... B65F 3/041; B65F 3/046
See application file for complete search history.

(56) References Cited

U.S. PATENT DOCUMENTS 5,266,000 A * 11/1993 LeBlanc, Jr. ..... B65F 3/02 294/68.3
5,484,245 A 1/1996 Zopf
5,607,277 A 3/1997 Zopf
5,639,201 A * 6/1997 Curotto ..... B65F 1/122 294/86.4
5,797,715 A 8/1998 Christenson
5,833,428 A * 11/1998 Szinte ..... 414/408
5,938,394 A 8/1999 Christenson
6,139,244 A 10/2000 VanRaden
D488,900 S * 4/2004 Grange ..... D34/3
7,273,340 B2 * 9/2007 Arrez ..... B65F 3/041 414/421
7,390,159 B2 6/2008 Rimsa et al.
7,871,233 B2 1/2011 Arrez et al.
2007/0243050 A1 10/2007 Arrez et al.
2010/0322749 A1 12/2010 Rowland et al.
2011/0038697 A1 2/2011 Arrez et al.

* cited by examiner

*Primary Examiner* — Jonathan Snelting
(74) *Attorney, Agent, or Firm* — Cook Alex Ltd.

(57) ABSTRACT

An intermediate container is provided for receiving refuse from a primary refuse container that is configured to be carried by a top-loading refuse collection vehicle lifter. The intermediate container comprises a front wall, a rear wall, opposed sidewalls, and a bottom wall defining a total refuse collection volume. An extension assembly is located substantially beneath the total refuse collection volume intermediate the front wall and the rear wall, with a portion of the extension assembly being movable between a first, retracted position for storage and for dumping a primary refuse collection container and a second, extended position for engaging and releasing the primary refuse collection container at a location laterally spaced from the intermediate container refuse collection vehicle. A mounting base is secured to the extension assembly that is configured for mounting a primary refuse collection container lifter thereon. Further, the intermediate container is free of fork receivers and includes at least one mounting member for non-destructive removable attachment to the collection vehicle lifter.

12 Claims, 14 Drawing Sheets

REFUSE COLLECTION SYSTEM

FIELD OF THE DISCLOSURE

The present application relates to a refuse collection system and components thereof, and more particularly to a refuse collection system including an automated front load collection container and a convertible mounting system for removably securing the collection container to the lift arms of a top loading refuse collection vehicle.

BACKGROUND

Front load refuse collection vehicles are in wide use in large-scale residential refuse collection. A front load refuse collection vehicle typically has a front cab, a large refuse collection compartment or cavity behind the cab having an upper opening for receiving refuse, and a pair of hydraulic-powered lift arms that carry forks that extend in front of the vehicle, the forks being adapted to be inserted into corresponding slots or sleeves (also sometimes called fork pockets or fork apertures) associated with an intermediate portable refuse collection container. The forks are able to lift the refuse container over the front of the vehicle and invert the container to dump its contents into the refuse compartment or body located behind the cab. For purposes of this description, the general term fork "receiver" will be used to refer fork-receiving sleeves, slots, pockets, apertures and other structures associated with a container for cooperating with the forks to allow lifting and inversion of the container.

For residential and small-scale refuse collection, the collection container is carried in front of the collection vehicle as it moves along the street. The contents of smaller residential collection carts (i.e., "primary" refuse collection containers) are first dumped into the intermediate collection container to fill the intermediate container, and the intermediate container is then inverted to dump its contents into a larger collection bin behind the vehicle cab.

Typically a hydraulic cart lifter is mounted to the intermediate collection container to grasp and invert the residential collection cart to dump its contents into the intermediate container. Hydraulic lifters also have been mounted to the intermediate collection container in a manner so that the lifter can be moved laterally relative to the intermediate container into engagement with the residential refuse cart for curb-side collection, without requiring the operator to move the refuse receptacle to the lifter. U.S. Pat. Nos. 5,484,245; 5,639,201; 5,797,715; and 6,139,244, all of which are hereby incorporated by reference, illustrate such arrangements. The present application is directed presents a new and unique arrangement, offering particular versatility for emptying, intermediate containers not found on prior systems.

SUMMARY OF THE DISCLOSURE

There are several aspects of the present subject matter that may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In a first aspect, an intermediate container is provided for receiving refuse from a primary refuse container that is configured to be carried by a top-loading refuse collection vehicle lifter. The intermediate container comprises a front wall, a rear wall, opposed sidewalls, and a bottom all defining a total refuse collection volume. An extension assembly is located substantially beneath the total refuse collection volume intermediate the front wall and the rear wall, with a portion of the extension assembly being movable between a first, retracted position for storage and for dumping a primary refuse collection container and a second, extended position for engaging and releasing the primary refuse collection container at a location laterally spaced from the intermediate container refuse collection vehicle. A mounting base is secured to the extension assembly that is configured for mounting a primary refuse collection container lifter thereon. Further, the intermediate container is free of fork receivers, and includes at least one mounting member for non-destructive removable attachment to the collection vehicle lifter.

In a second aspect, a convertible mounting system is provided that is configured for attachment to spaced-apart lift arms of a top loading refuse collection vehicle and allows the vehicle to selectively dump an intermediate collection container having fork receivers and an intermediate collection container without fork receivers. The convertible mounting system comprises a cross member for extending between and attaching to the lift arms of the collection vehicle. Spaced-apart mounting connectors are fixedly attached to the cross member. The mounting connectors are configured for selective and non-destructive removable attachment (a) to forks for lifting an intermediate container having fork receivers, or (b) to an intermediate container having mounting members for non-destructive removable attachment to the mounting connectors and being free of fork receivers.

In a third aspect, the combination of an intermediate refuse collection container and a convertible lifter assembly is provided in which the convertible lifter assembly is configured for attachment to spaced lift arms or members of a top loading refuse collection vehicle so as to allow the vehicle either to dump an intermediate collection container having fork receivers or to dump an intermediate collection container lacking fork receivers. The convertible lifter assembly comprises a cross member that extends between and is attachable to the lift arms of the collection vehicle. Spaced-apart mounting connectors are fixedly attached to the cross member and configured for selective non-destructive removable attachment (a) to container lift forks for lifting intermediate containers having fork receivers or (b) to an intermediate container having mating mounting members and being free of fork receivers. The intermediate refuse collection container is configured without fork receivers to be carried by the convertible lifter assembly and comprises a front wall, a rear wall, opposed sidewalls, and a bottom wall defining a total refuse collection volume. An extension assembly is provided that is positioned substantially beneath the total refuse collection volume intermediate the front wall and the rear wall, with the extension assembly being movable between a first, retracted position for storage and for dumping a primary refuse collection container and a second, extended position for engaging and releasing the primary refuse collection container at a location laterally spaced from the intermediate container. A mounting base is secured to the extension assembly and a primary refuse collection container lifter carried on the mounting base at a location lateral to a side wall of the intermediate container.

In a fourth aspect, a top loading refuse collection vehicle is provided that comprises a refuse collection cavity with an upper refuse receiving opening. A pair of lift arms is secured to the vehicle so as to be pivotal between a first position in front of the vehicle and a raised position over the refuse collection cavity. A convertible mounting system is carried by the lift arms and is configured for selective non-destructive removable attachment either to container lift forks for lifting and dumping intermediate collection containers having fork receivers or to an intermediate refuse collection container lacking fork receivers.

In a fifth aspect, a method of refuse collection with a refuse collection vehicle including a top loading collection hopper and lift arms for lifting and dumping an intermediate collection container into the collection hopper is provided. The method comprises non-destructively removably attaching intermediate container lift forks to the lift arms; lifting and dumping an intermediate collection container having fork receivers; non-destructively removing the container lift forks from the lift arms; and non-destructively removably attaching the lift arms to an intermediate container lacking fork receivers.

DETAILED DESCRIPTION

The embodiments disclosed herein are for the purpose of providing an exemplary description of the present subject matter. They are, however, only exemplary, and the present subject matter may be embodied in various forms. Therefore, specific details disclosed herein are not to be interpreted as limiting the subject matter as defined in the accompanying claims.

Figure 1:
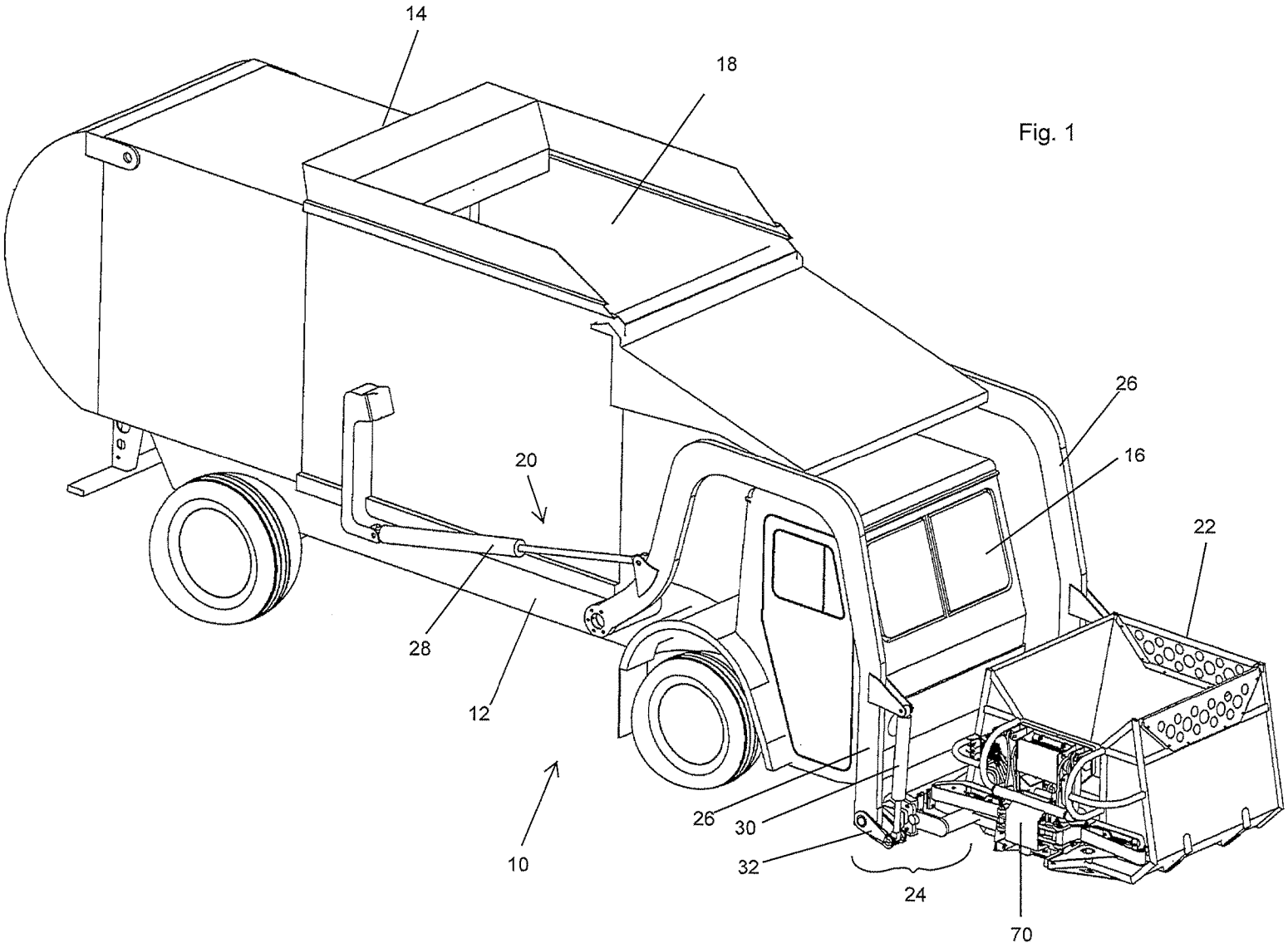
FIG. 1 is a perspective view of a refuse collection vehicle and an intermediate front load collection container having a convertible mounting system in accordance with the present disclosure.
Figure 2:
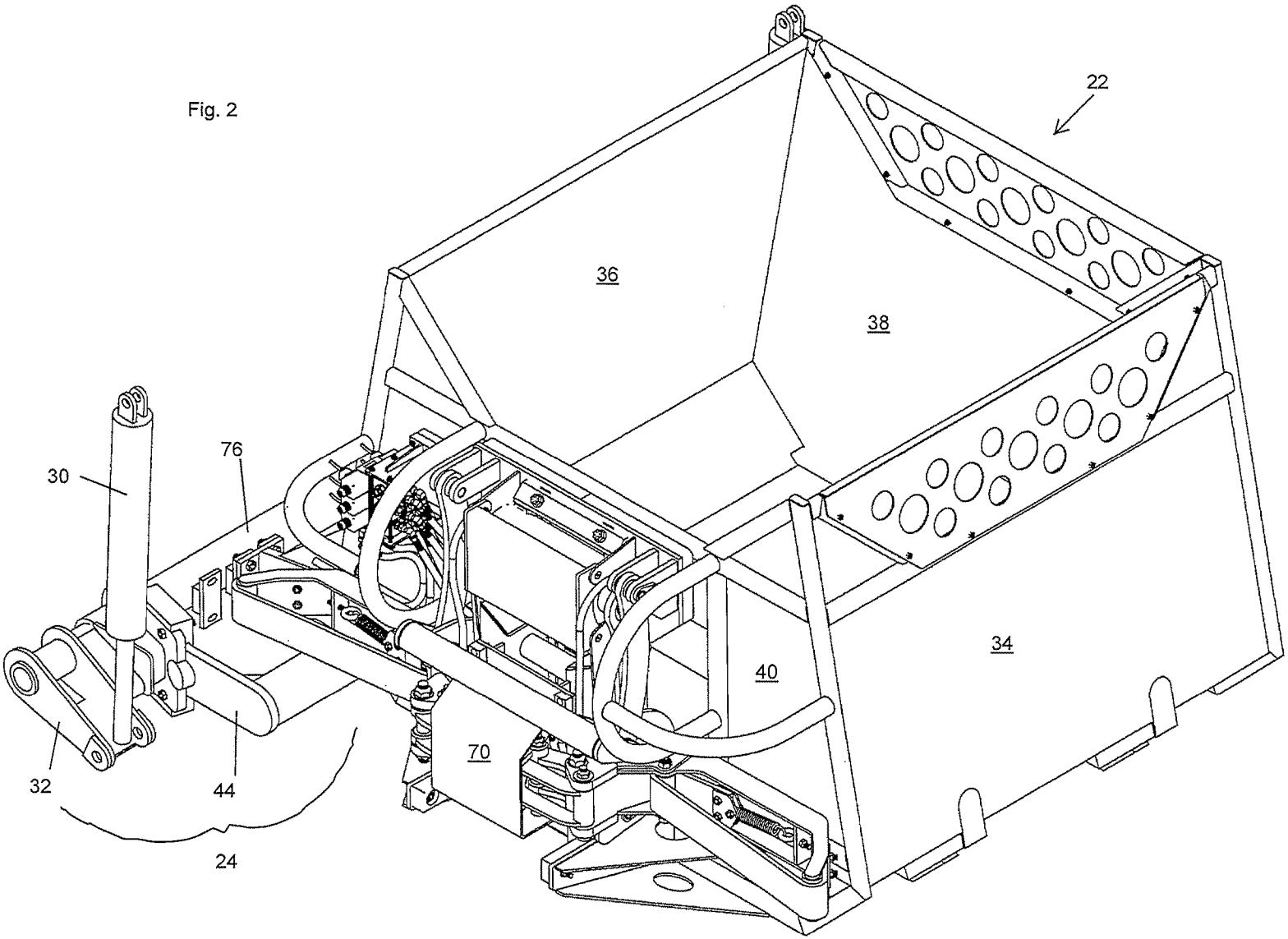
FIG. 2 is an enlarged perspective view of the intermediate front load collection container having a convertible mounting system of FIG. 1 showing the collection container mounted to the lift arms of the refuse collection vehicle.
Figure 3:
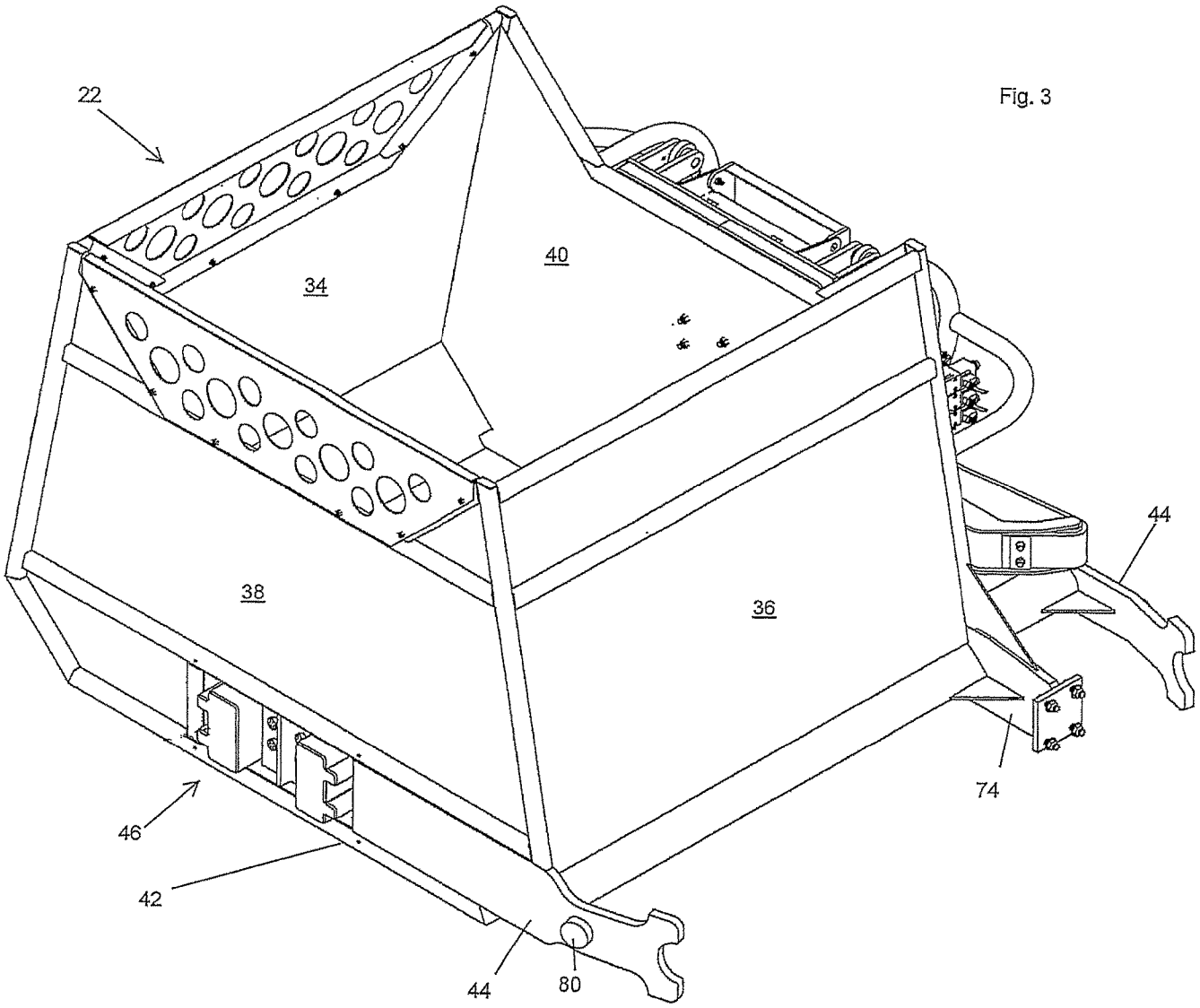
FIG. 3 is an enlarged perspective view of the intermediate front load collection can having a convertible mounting system of FIG. 2 separate from the lift bar of the refuse collection vehicle.
Figure 4:
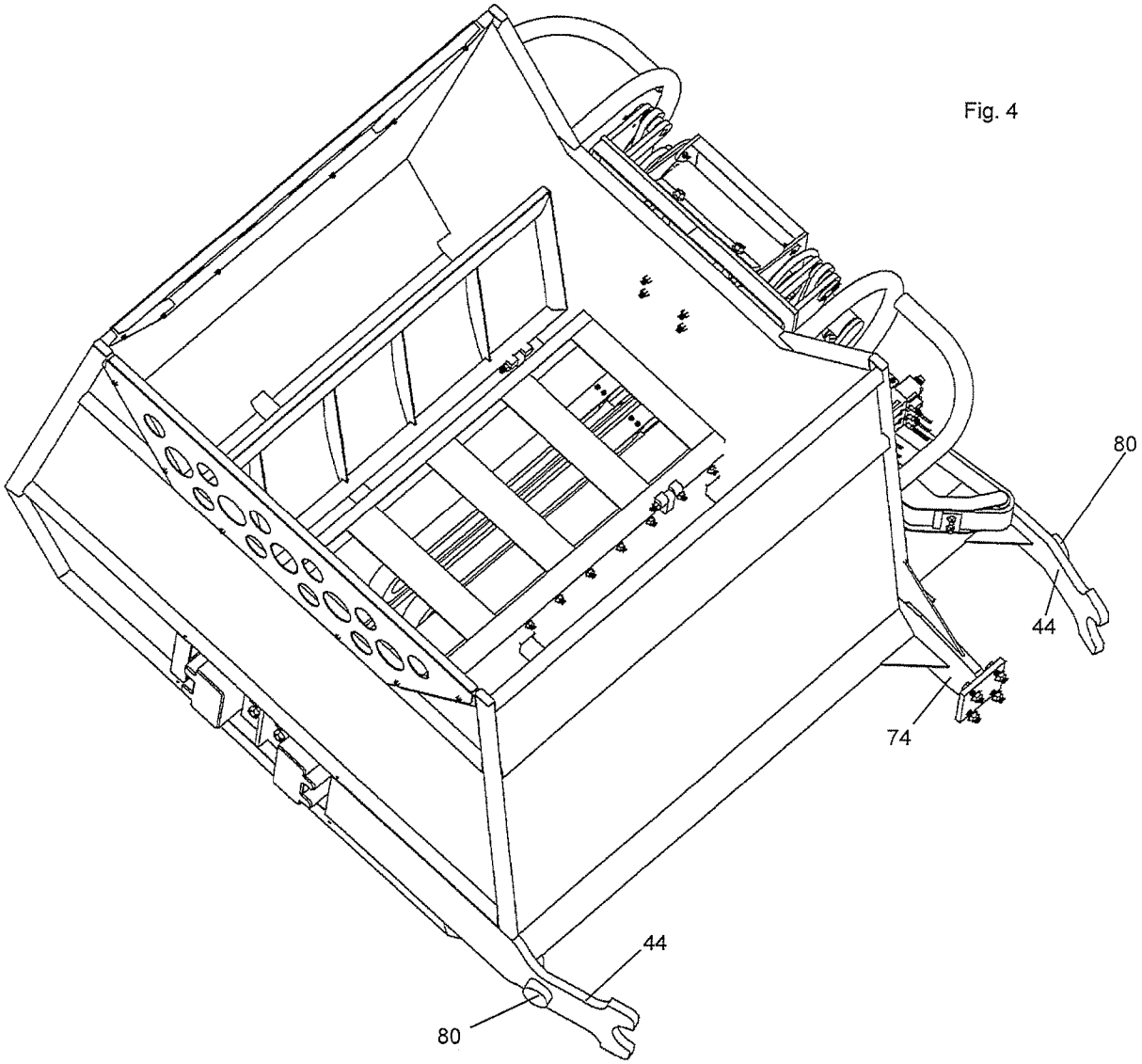
FIG. 4 is an enlarged perspective view of the intermediate front load collection container having a convertible mounting system similar to FIG. 3, but from a different angle, so as to show some of the interior of the collection container, including the slide system for moving the primary refuse collection container lifter laterally from the refuse collection vehicle.
Figure 10:
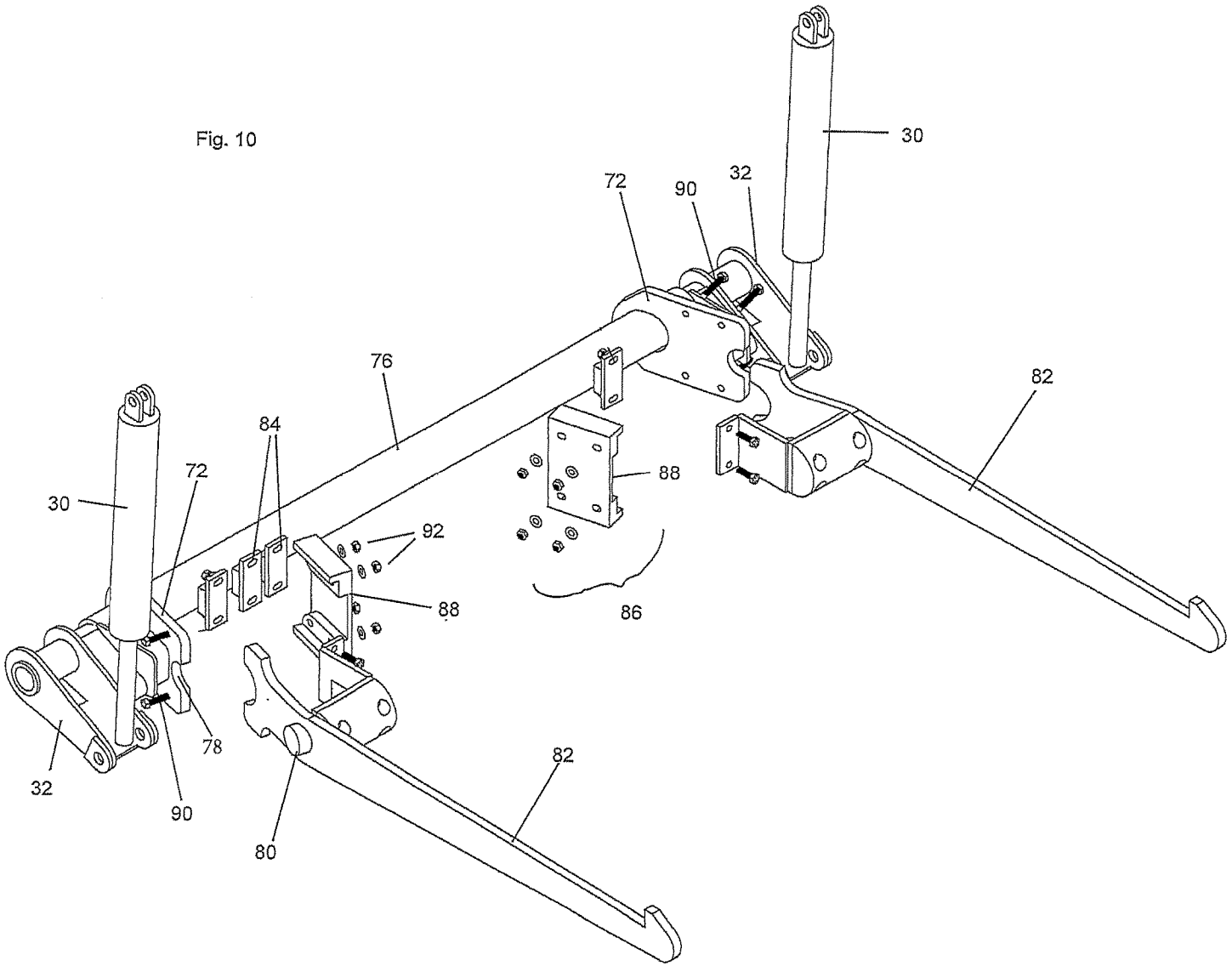
FIG. 10 is an exploded perspective view showing the convertible mounting system in combination with lift forks configured for lifting a standard, fork mounted intermediate front load collection can of the type having fork receivers.
Figure 11B:
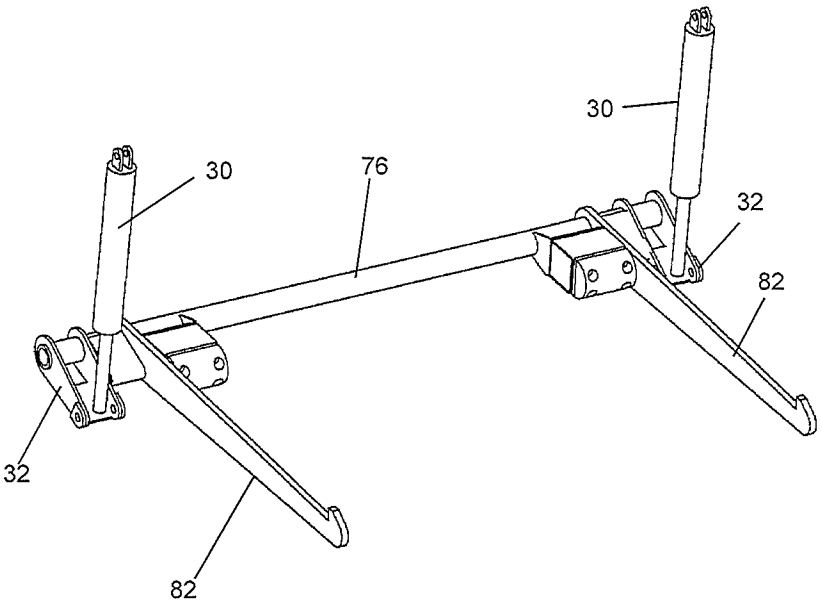
FIGS. 11A and 11B are perspective views of the convertible fork mounting system according to the present disclosure for mounting an intermediate container as described herein (FIG. 11A) and for having a pair of forks mounted thereto (FIG. 11B).
Figure 11A:
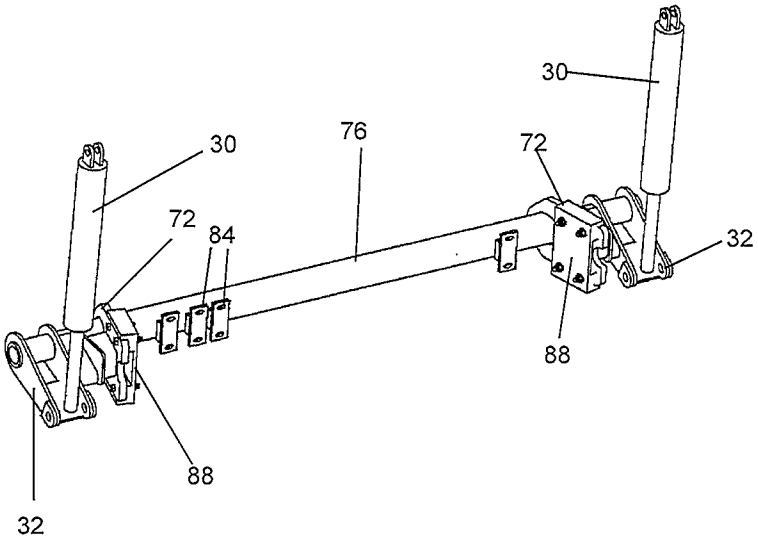
Figure 12:
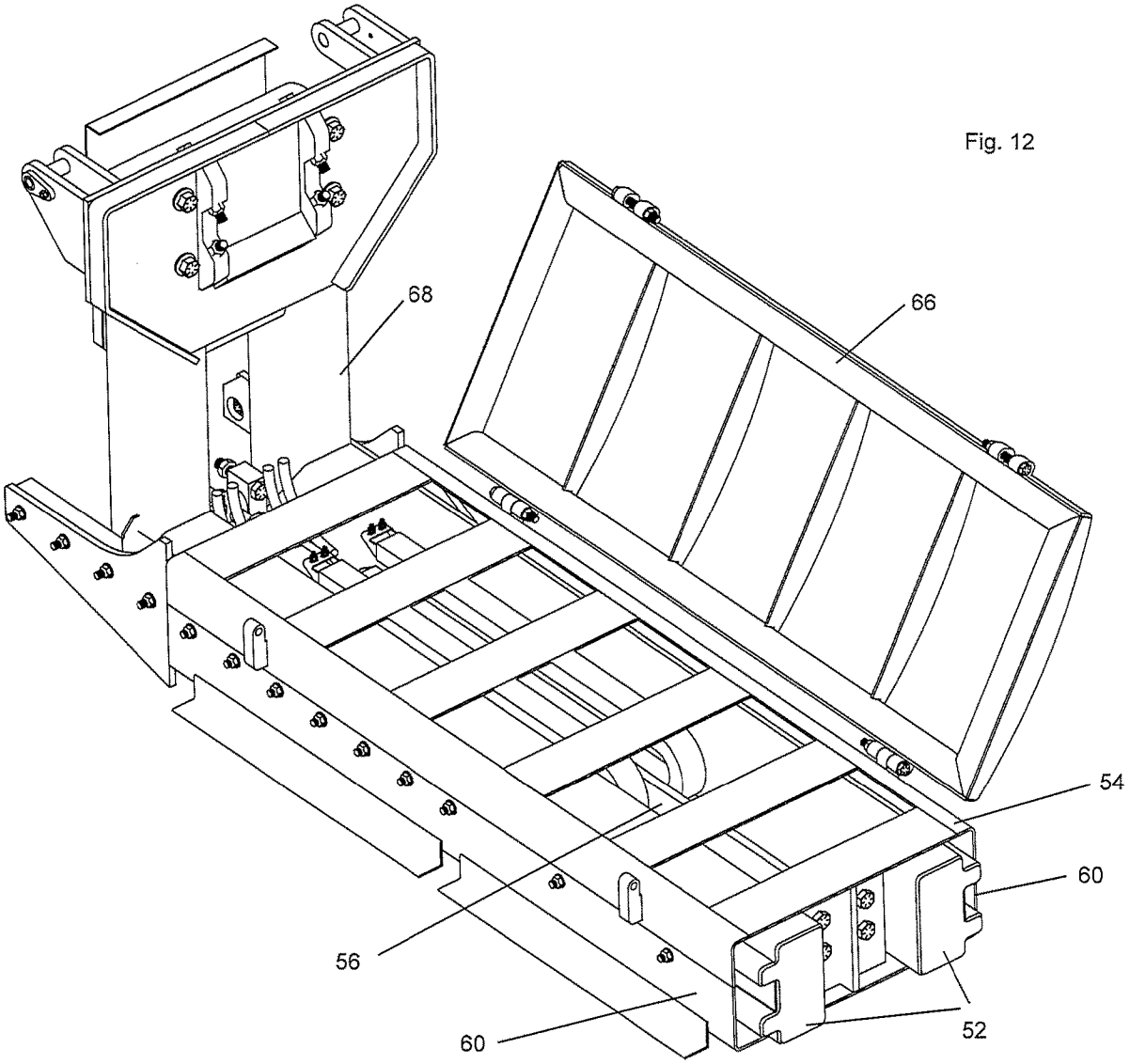
FIG. 12 is a perspective view of the slidable mounting system for supporting a lifter (with the lifter omitted to show details), including a track having a side frame configured to be secured to the bottom all of the refuse collection container that slidably receives a slide that includes on one end the mount to which the lifter is to be affixed, and a hood/lid attached by, e.g., hinges, to permit access to an extension cylinder for moving the slide back and forth along the track.

With reference to FIG. 1, there is seen a refuse collection system, generally designated 10, embodying various aspects of the present disclosure, namely a top loading refuse collection vehicle 12 having a large refuse collection compartment or hopper 14 behind the cab 16 and having an upper opening 18 for receiving refuse and including a lift mechanism 20, an intermediate refuse collection container 22, and a mounting system 24 (better seen in FIGS. 10, 11A and 11B).

The lift mechanism 20 includes a pair of lift arms 26 pivotally attached to opposite sides of the body of the collection vehicle 12, such that the lift arms 26 carry the mounting system 24. An actuator 28 is pivotally attached to each lift arm 26 for moving the lift arms 26 between a first position, in which the intermediate container is carried upright in front of the collection vehicle 12 (as shown in FIG. 1), and a second position in which the intermediate container 22 is inverted for dumping its contents into the opening 18 of the hopper 14 (not shown).

As described in greater detail below, the mounting system 24 is convertible to permit its use with either intermediate collection containers that have fork receivers (not shown in FIG. 1), or intermediate collection containers that do not have such fork receivers (such as the intermediate collection container described herein). The mounting system 24 is pivotally mounted to the ends of the lift arms 26, with an actuator 30 interposed between each lift arm 26 and a pivot arm 32 associated with the mounting system 24 for rotating the mounting system 24 between a first, forward facing position (in which forks associated with the mounting system would extend forwardly for insertion and receipt in the fork receivers of an intermediate container) and a second generally-upward facing position (in which forks associated with the mounting system would extend generally vertically for storage or during vehicle movement in the absence of an intermediate container).

The intermediate container 22 comprises a front wall 34, a rear wall 36, opposed sidewalls 38, 40, and a bottom wall 42 so as to define a total refuse collection volume. The intermediate container 22 is free of fork receivers but instead includes one or more mounting members 44 for non-destructive removable attachment of the collection container 22 to the collection vehicle lift mechanism 20.

Figure 5:
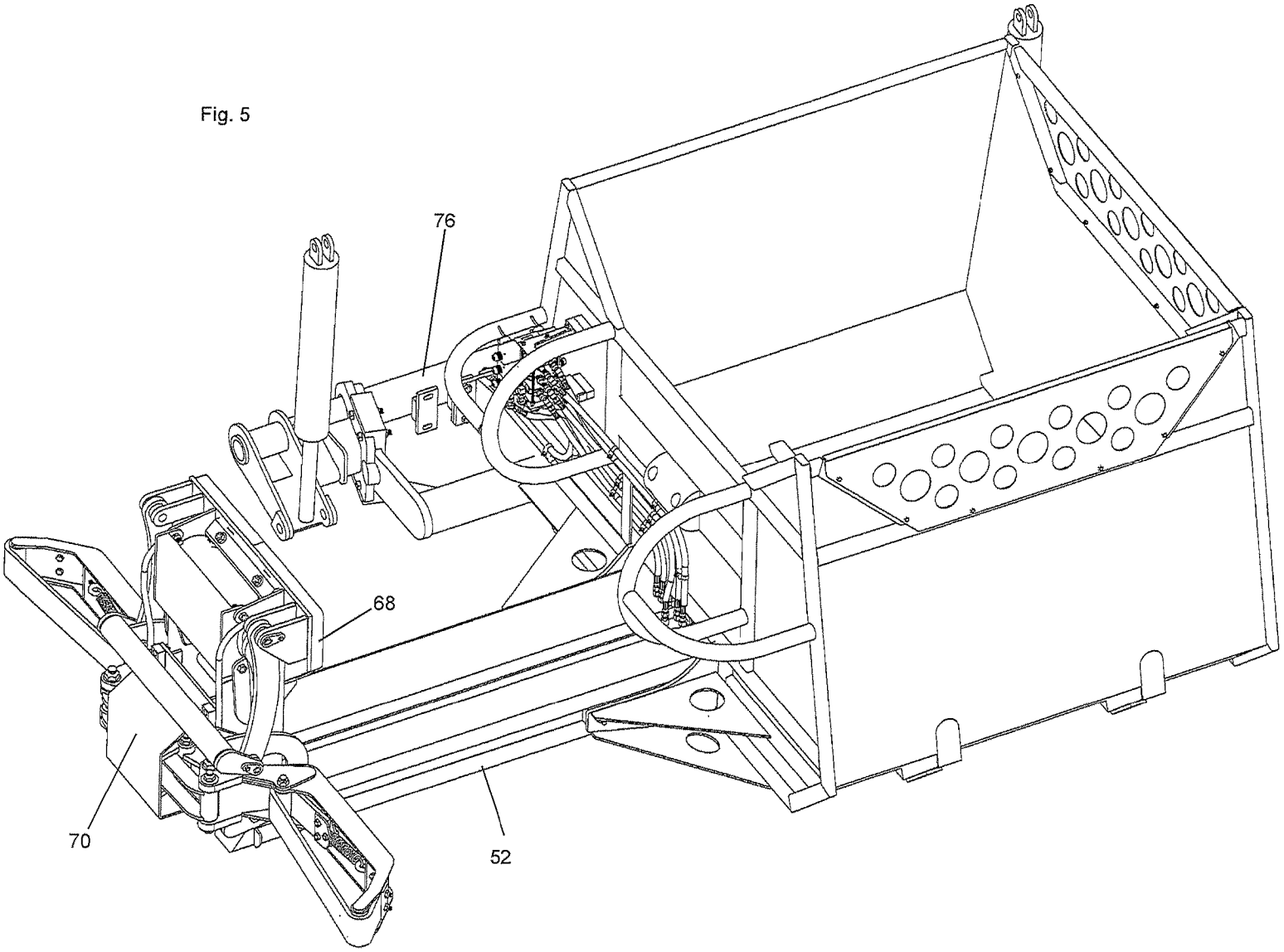
FIG. 5 is an enlarged perspective view of the intermediate front load collection container having a convertible mounting system similar to FIG. 2 showing the collection container mounted to the lift arms of the refuse collection vehicle and with the primary refuse collection container lifter spaced laterally from the intermediate collection container for engaging or disengaging a primary refuse collection container.
Figure 6:
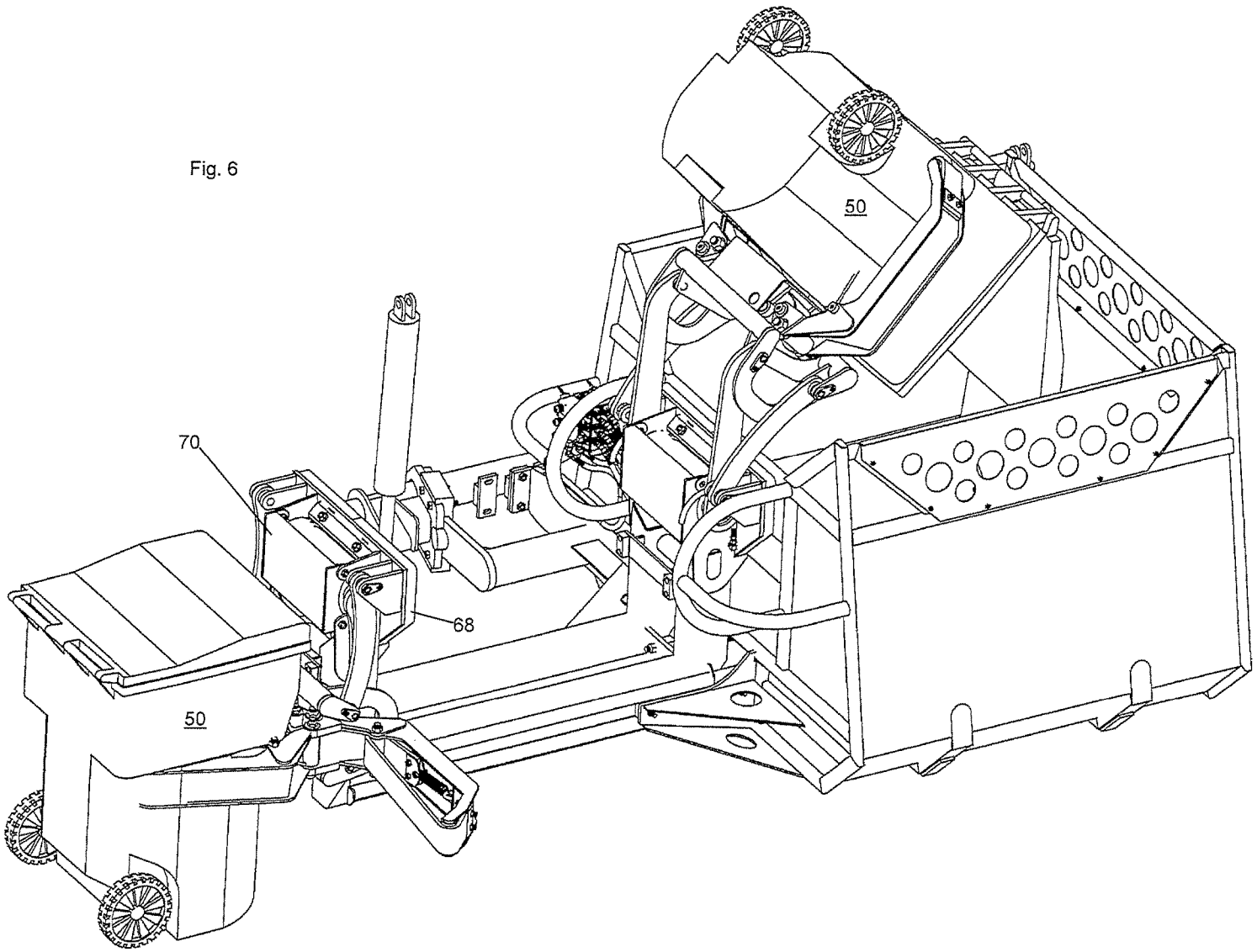
FIG. 6 is a perspective view similar to FIG. 5 showing the primary refuse collection container lifter in both a laterally-spaced position for engaging/disengaging a primary refuse collection container, and in a retracted, dumping position in which the primary refuse collection container is inverted by the lifter for dumping its contents into the intermediate front load collection container.
Figure 7:
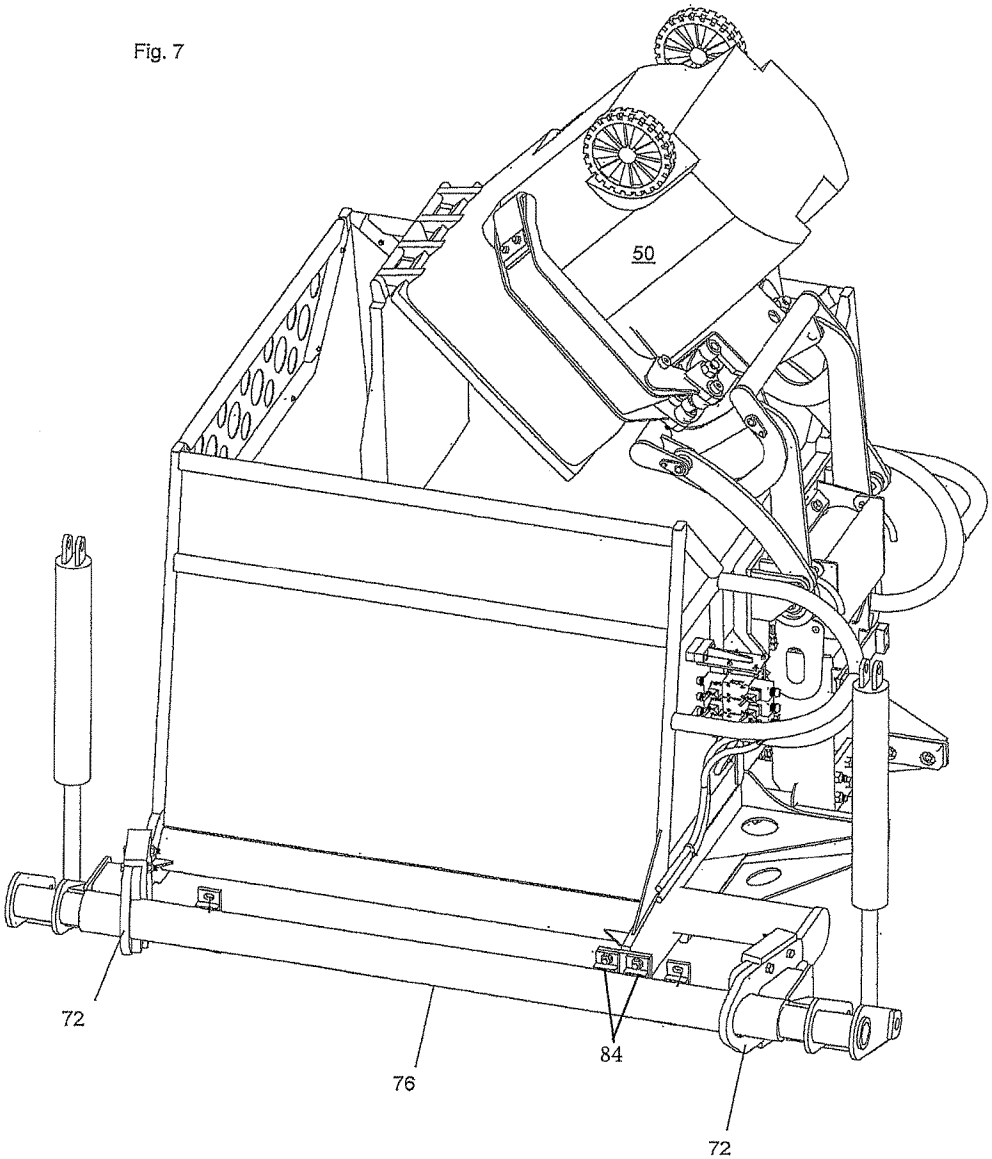
FIG. 7 is a perspective view showing the primary refuse collection container lifter in a retracted, dumping position in which the primary refuse collection container is inverted by the lifter for dumping its contents into the intermediate front load collection container.
Figure 8:
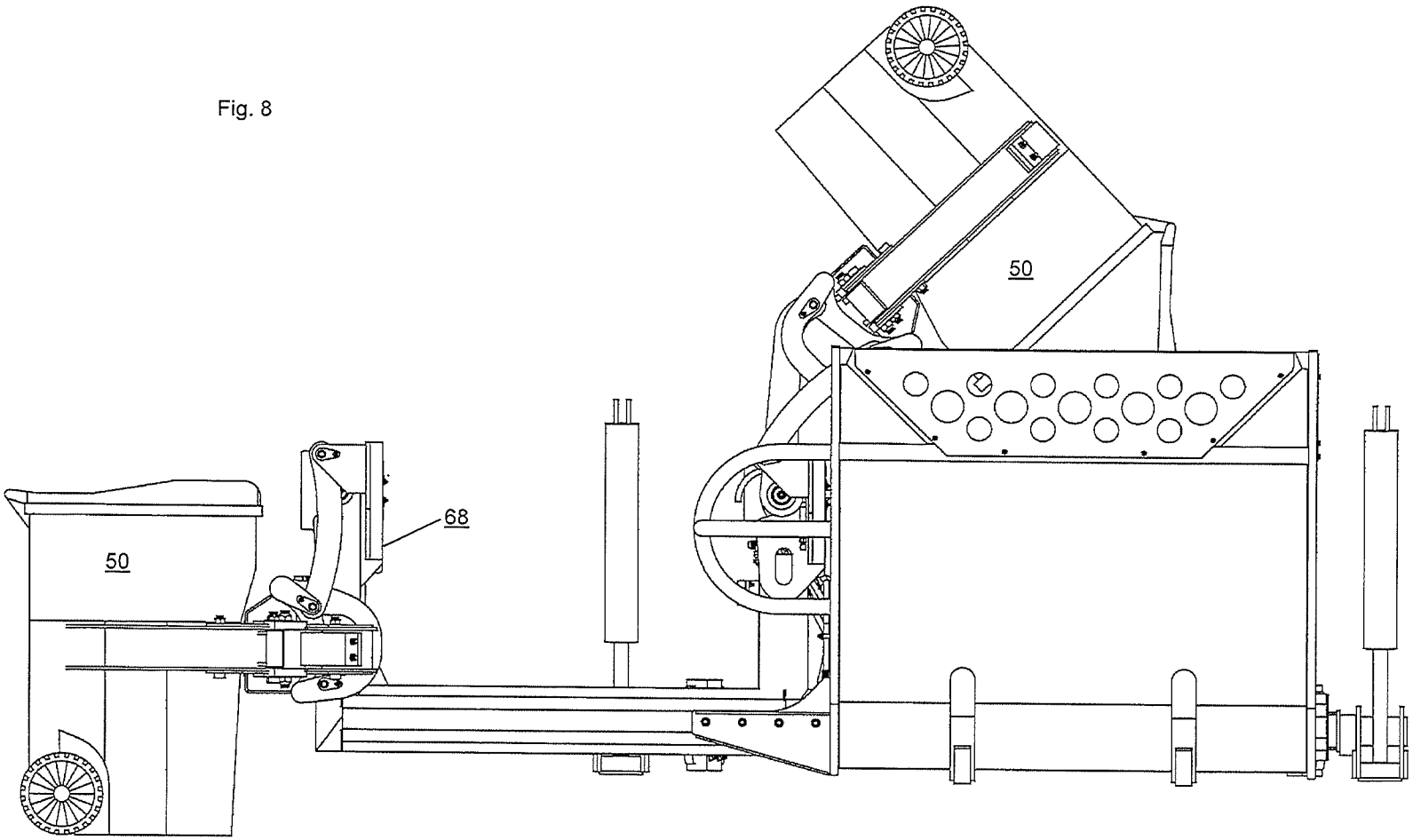
FIG. 8 is a front view similar to FIG. 6 showing the primary refuse collection container lifter in both a laterally-spaced position for engaging/disengaging a refuse collection container, and in a retracted, dumping position in which the primary refuse collection container is inverted by the lifter for dumping its contents into the intermediate front load collection container.
Figure 9:
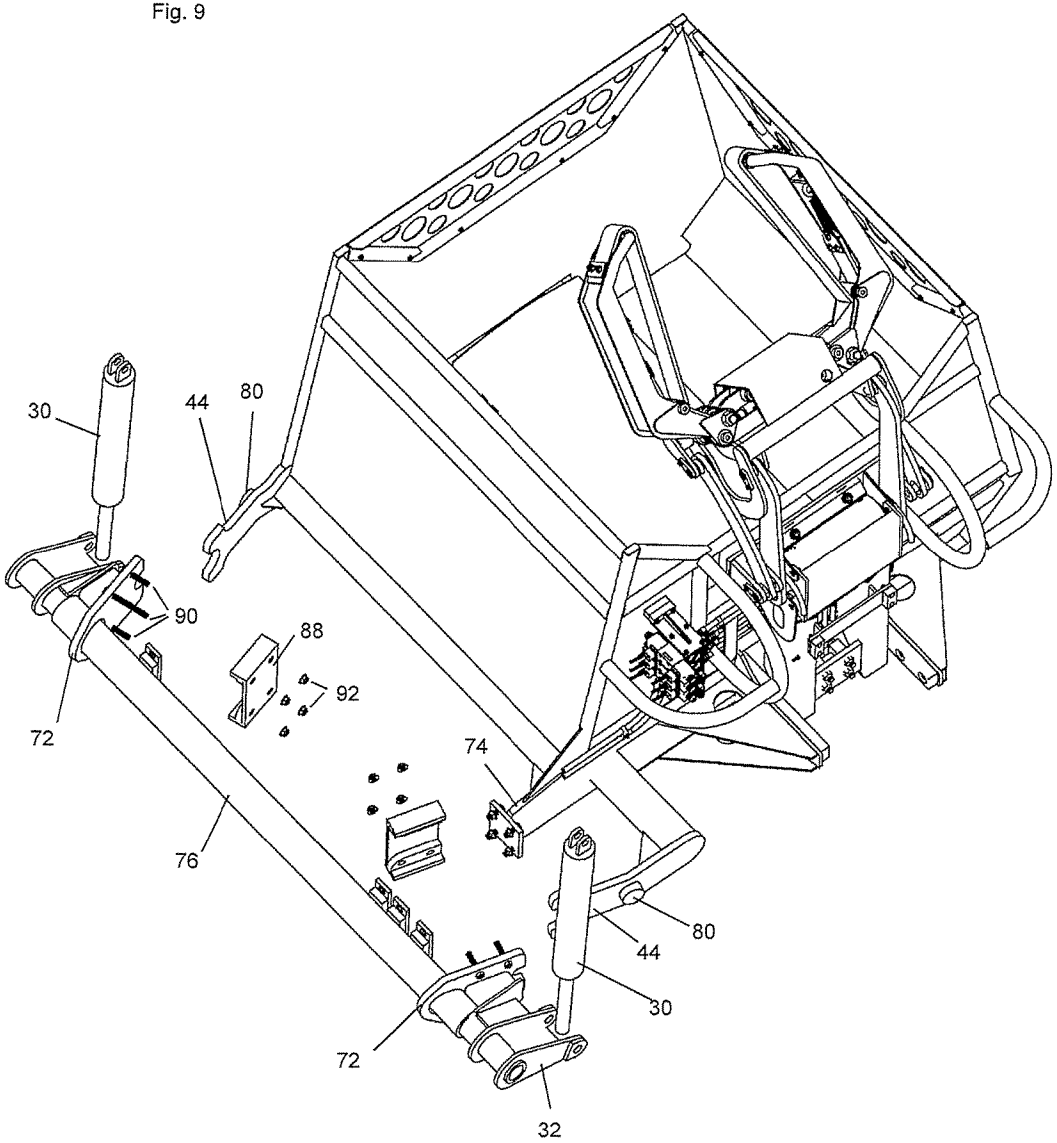
FIG. 9 is an exploded perspective view showing the intermediate front load collection container spaced from the cross or lift bar to which it is to be attached and better showing the convertible mounting system.

An extension assembly, generally designated 46, is positioned substantially along or beneath the bottom all of the intermediate container, such as beneath the total refuse collection volume intermediate the front wall 34 and the rear wall 36, with a portion of the extension assembly 46 being movable between a first, retracted position (shown in, e.g., FIGS. 1-4) for storage and for dumping a primary refuse collection container 50, and a second, extended position (shown, e.g., in FIG. 5) for engaging and releasing the primary refuse collection container at a location laterally spaced from the intermediate container 22 and the refuse collection vehicle 12.

As illustrated, the extension assembly 46 includes a rigid extension member 52 and a track assembly 54 carried by the container 22 that cooperates with the rigid extension member 52 to allow lateral reciprocal movement of the rigid extension member 52 relative to the side wall 40 of the container 22. An actuator 56, such as a hydraulic cylinder, is provided for moving the rigid extension member 52 back and forth along the track 54.

Figure 13:
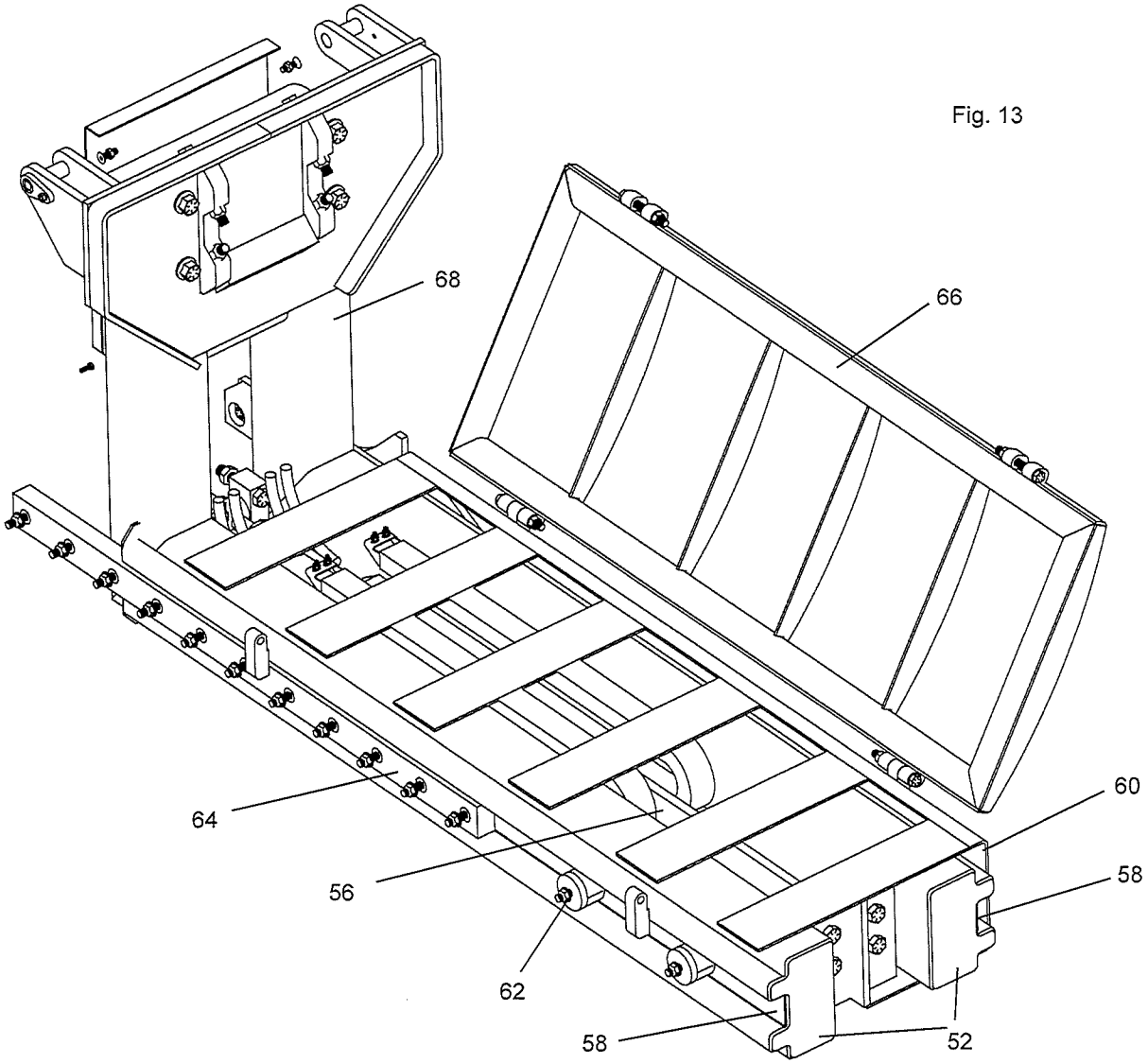
FIG. 13 is a perspective view similar to FIG. 12 with portions of the track removed to show detail.
Figure 14:
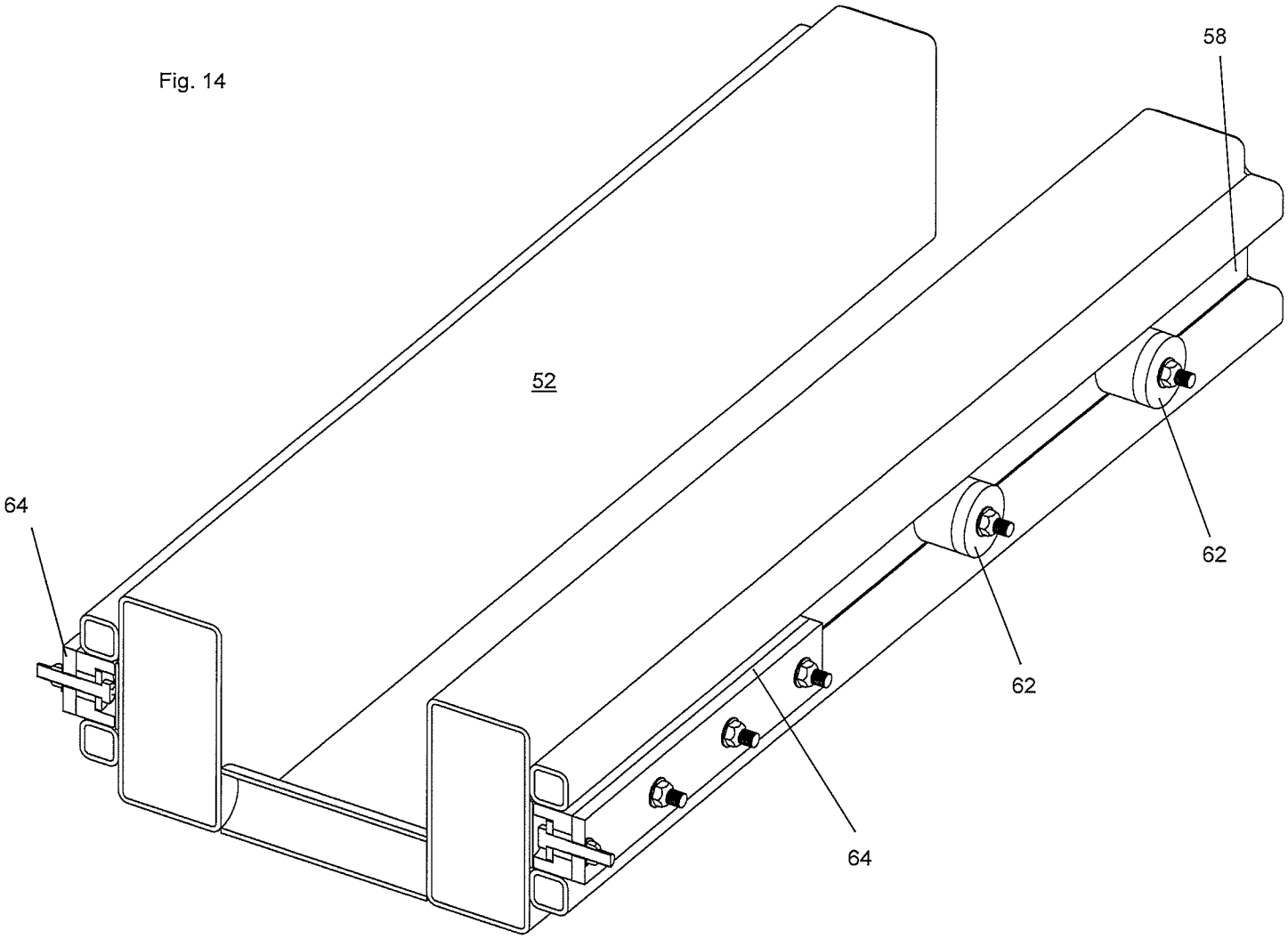
FIG. 14 is a fragmentary perspective view showing the slide and a cooperating portion of the track that is received in a channel in the slide.

As best seen in FIG. 13, the rigid extension member 52 has opposed side edges, each of which includes a roller channel 58. The track assembly has opposed side frames 60, each of which carries a plurality of rollers 62 and a self-lubricating guide block 64, each of which is received within a respective one of the roller channels 58. An openable access panel 66 is provided that defines a portion of the container bottom wall 42, such that at least a portion of the extension assembly 46 is located below the access panel 66.

A mounting base 68 is secured to the extension assembly 46 that is configured for mounting a primary refuse collection container lifter 70 thereon for engaging and dumping primary refuse containers into the intermediate container. Exemplary container lifters are shown in U.S. Pat. No. 7,390,159 and US 2011/0038697, which have the same assignee as the present application, and which are incorporated by reference herein. Any desired lifter, however, may be used.

In keeping with another aspect of the disclosure, the intermediate container 22 includes a plurality of spaced apart mounting members 44 for removably and non-destructively mounting the intermediate container 22 to lift arms 26 associated with the lift mechanism 20 of the refuse collection vehicle 12. The mounting members 44 extend generally rearwardly from the intermediate container 22, and are configured to engage mating connectors 72 (best seen in FIGS. 10, 11A and 11B, and described in greater detail below), so as to bring the mounting members 44 and connectors 72 into alignment as a collection vehicle 12 and the intermediate container 22 are moved into proximity during joinder.

As illustrated, the container mounting members 44 preferably extend at a diverging or converging angle (a converging angle being shown) relative to the rear wall 36 of the intermediate container 22. Preferably, the intermediate container 22 further includes a brace 74 extending rearwardly intermediate the container mounting members 44 that also provides for non-destructive removable attachment of the intermediate container 22 to the mounting system 24 of the collection vehicle 12.

In keeping with another aspect of the disclosure, the mounting system 24 is configured so as to be convertible to permit its use with either an intermediate collection container having fork receivers or an intermediate collection container without fork receivers. To this end, the mounting system 24 includes a cross member 76 that extends between and pivotally attaches to the lift arms 26 of the lift mechanism 20 for the collection vehicle 12. Spaced-apart mounting connectors 72 are fixedly attached to the cross member 76 (by, e.g., welding) and are configured for selective and non-destructive removable attachment to either forks for lifting an intermediate container having fork receivers, or to the mounting members of the intermediate container described above, which is free of fork receivers.

As Illustrated, the mounting connectors 72 comprise mounting plates that extend at an acute angle relative to the axis of the cross member 76. More specifically, the connectors 72 extend at a diverging angle for engagement with mounting members 44 that extend rearwardly from the collection container 22 at a converging angle. This arrangement helps align the vehicle and intermediate container as they are moved toward one another. To enhance the ease and strength of the connection, each mounting connector 72 preferably includes any suitable registration shape 78 for mating engagement with a complementary registration shape 80 on the respective intermediate container mounting member 44 or container fork 82. To this end, the mounting connectors 72, as specifically illustrated, have forward-facing saddles or concave recesses 78 for receiving raised circular bosses 80 that are integral with the container fork 82 or the mounting member 44 of the intermediate container 22. The cross member 76 further includes an attachment point 84 on the cross member 76 intermediate the mounting connectors 72 for attachment to the brace 74 that extends rearwardly from the intermediate container 22.

In addition, fastening assemblies, generally designated 86, are provided for non-destructively and removably attaching each mounting connector 72 to a container lift fork 82 or a mating connector 44 on the intermediate container 22. As illustrated, the fastening assemblies 86 are configured to attach a mounting member 44 and mounting connector 72 together in face to face relation by means of a plate 88 and a plurality of bolts 90 and nuts 92. The plate is generally cross-sectionally u-shaped, with opposed flanges which overlap the adjoining portions of the connectors 72 and members 44 to enhance rigidity when connected. The rigid connection of the intermediate container to the cross member by the mounting members 44 and brace 74 is believed to reduce shock and vibration that can occur during lifting and dumping when using vehicle forks and standard intermediate container using fork receivers.

The system described above thus provides for a method of refuse collection with a refuse collection vehicle that comprises non-destructively removably attaching intermediate container lift forks to the lift arms; lifting and dumping an intermediate collection container having fork receivers; non-destructively removing the container lift forks from the lift arms; and non-destructively removably attaching to the lift arms an intermediate container lacking fork receivers. This versatile arrangement allows the same refuse collection vehicle to be used with forks for dumping commercial refuse collection containers with fork receivers, such as encountered on commercial refuse collection routes, and then after conversion by removal of the forks and attachment of the intermediate collection contain, to be used for residential routes where refuse is collected from primary curb-side collection containers, and, if desired, converted by to the use forks for commercial routes, as needed by the waste hauler.

The invention claimed is:

1. An intermediate refuse collection container in combination with a convertible lifter assembly, the convertible lifter assembly being configured for attachment to spaced lift members of a top loading refuse collection vehicle, the convertible lifter assembly allowing the vehicle to dump an intermediate collection container having fork-receiving apertures or pockets and to dump an intermediate collection container lacking fork receiving pockets, the convertible lifter assembly comprising:

a) cross member for extending between and attachment to the lift members of a top loading collection vehicle;

b) spaced-apart mounting connectors fixedly attached to the cross member and configured for selective non-destructive removable attachment to container lift forks for lifting intermediate containers having fork-receiving apertures or pockets or to an intermediate container having mating mounting members and being free of fork-receiving apertures or pockets; and the intermediate refuse collection container for receiving refuse from a primary refuse container and being configured without fork receiving apertures or pockets to be carried by the convertible lifter assembly, the intermediate container comprising:

a) a front wall, a rear wall, opposed sidewalls, and a bottom wall defining a total refuse collection volume;

b) an extension assembly substantially beneath the total refuse collection volume intermediate the front wall and the rear wall, the extension assembly being movable between a first, retracted position for storage and for dumping a primary refuse collection container and a second, extended position for engaging and releasing the primary refuse collection container at a location laterally spaced from the intermediate container, the extension assembly further comprising a track assembly with first and second side frames horizontally spaced-apart along the bottom wall of the intermediate refuse collection container, a rigid extension member with first and second spaced-apart slide members, a slide member being associated with each side frame, and an actuator positioned between the slide members for moving the rigid extension member relative to the track assembly; and c) a mounting base secured to the extension assembly and a primary refuse collection container lifter carried on the mounting base at a location lateral to a side wall of the intermediate container.

2. The combination of claim 1 in which each slide member of the rigid extension member has an outwardly-facing roller channel, and each of the spaced-apart side frames of the track assembly includes a plurality of rollers received within a respective one of the roller channels.

3. The combination of claim 1 in which the intermediate container includes spaced apart mounting members for mounting to the convertible lifter assembly.

4. The combination of claim 3 in which the intermediate container mounting members extend generally rearwardly from the intermediate container.

5. The combination of claim 3 in which the intermediate container mounting members are configured to engage the mounting connectors on the convertible lifter assembly so as to bring the mounting members and mounting connectors into alignment as the convertible lifter assembly and the intermediate container are moved into proximity during joinder.

6. The combination of claim 3 in which the intermediate container further comprises a brace extending rearwardly intermediate the container mounting members for attachment to the convertible lifter assembly.

7. An intermediate container for receiving refuse from a primary refuse container, and configured to be carried by a top-loading refuse collection vehicle having a top-loading refuse collection vehicle lifter, the intermediate container comprising:

a) a front wall, a rear wall, opposed sidewalls, and a bottom wall defining a total refuse collection volume;

b) an extension assembly substantially beneath the total refuse collection volume intermediate the front wall and the rear wall, a portion of the extension assembly being movable between a first, retracted position for storage and for dumping a primary refuse collection container and a second, extended position for engaging and releasing the primary refuse collection container at a location laterally spaced from the intermediate container and the refuse collection vehicle, the extension assembly further comprising a track assembly with first and second side frames horizontally spaced-apart along the bottom wall of the intermediate refuse collection container, a rigid extension member with first and second spaced-apart slide members, a slide member being associated with each side frame, and an actuator positioned between the slide members for moving the rigid extension member relative to the track assembly;

c) a mounting base secured to the extension assembly and configured for mounting a primary refuse collection container lifter thereon; and d) the intermediate container being free of fork-receiving pockets or apertures and including at least one mounting member for non-destructive removable attachment to the collection vehicle lifter.

8. The intermediate container of claim 7 in which each slide member of the rigid extension member has an outwardly-facing roller channel, and each of the spaced-apart side frames of the track assembly includes a plurality of rollers received within a respective one of the roller channels.

9. The intermediate container of claim 7 comprising an openable access panel defining a portion of the container bottom wall, at least a portion of the extension assembly being located below the access panel.

10. The intermediate container of claim 7 including spaced apart mounting members for mounting removably non-destructively the intermediate container to lift arms associated with the lifter of a top loading refuse collection vehicle.

11. The intermediate container of claim 10 in which the mounting members extend generally rearwardly from the intermediate container.

12. The intermediate container of claim 10 further comprising a brace extending rearwardly intermediate the container mounting members for non-destructive removable attachment to a collection vehicle.

* * * * *